US005121884A

United States Patent [19]

Noakes

[11] Patent Number: 5,121,884

[45] Date of Patent: Jun. 16, 1992

[54] ELECTROSTATIC SPRAYING DEVICES

[75] Inventor: Timothy J. Noakes, Pantmyn, Wales

[73] Assignee: Imperial Chemical Industries PLC, England

[21] Appl. No.: 647,063

[22] Filed: Jan. 29, 1991

[30] Foreign Application Priority Data

Feb. 6, 1990 [GB] United Kingdom ..... 9002631

[51] Int. Cl.[5] ..... B05B 5/00

[52] U.S. Cl. ..... 239/691; 239/696; 239/708

[58] Field of Search ..... 239/690, 691, 696, 708, 239/375; 361/227, 228

[56] References Cited

U.S. PATENT DOCUMENTS

| | | | |
|---|---|---|---|
| 2,914,221 | 11/1959 | Rosenthal | 239/690 |
| 3,495,779 | 2/1970 | Renner et al. | 239/690 |
| 3,630,441 | 12/1971 | Felici et al. | 239/692 |
| 4,139,155 | 2/1979 | Hastings | 239/708 |
| 4,306,685 | 12/1981 | Coffee | 239/690 |
| 4,331,298 | 5/1982 | Bentley et al. | 239/690 |
| 4,398,671 | 8/1983 | Coffee | 239/690 |
| 4,401,274 | 8/1983 | Coffee | 239/690 |
| 4,577,803 | 3/1986 | Owen | 239/690 |
| 4,962,885 | 10/1990 | Coffee | 239/690 |
| 4,971,257 | 11/1990 | Birge | 239/708 |

FOREIGN PATENT DOCUMENTS

| | | | |
|---|---|---|---|
| 509399 | 3/1952 | Belgium . | |
| 0118202 | 2/1984 | European Pat. Off. . | |
| 1004558 | 3/1957 | Fed. Rep. of Germany . | |
| 2061769 | 5/1981 | United Kingdom | 239/690 |
| 2197225 | 5/1988 | United Kingdom . | |

*Primary Examiner*—Andres Kashnikow
*Assistant Examiner*—Lesley D. Morris
*Attorney, Agent, or Firm*—Cushman, Darby & Cushman

[57] ABSTRACT

An electrostatic spraying device is designed in such a way that potential surface leakage paths (FIG. 1*b*) along which current may leak from the HT generator (2*b*) are sufficiently long to allow the use of a generator having a smaller than conventional maximum current output.

22 Claims, 7 Drawing Sheets

ELECTROSTATIC SPRAYING DEVICES

This invention relates to electrostatic spraying devices.

Energy efficiency and generator current capacity are not viewed as important in most conventional electrostatic spraying applications, since most use is in heavy industrial applications. In attempting to design small and/or hand held devices for the domestic market, for example, one of the major costs is that of the high voltage supply, usually in the form of a generator, Reducing the current output required from the generator enables it to be built less expensively. However, a problem with previously proposed devices is that if the output current of the generator is reduced significantly, the devices function less effectively or not at all.

Broadly, the inventive concept recognises that it is possible to use a generator which has a current capacity much smaller than is conventional.

In accordance with one aspect of the invention, there is provided an electrostatic spraying device comprising a nozzle, means for supplying liquid to the nozzle, high voltage supply means having a high voltage output supplying a high voltage circuit comprising one pole of the high voltage output connected, in use, so that liquid sprayed from the nozzle is electrostatically charged, in use leakage between the poles of the high voltage output of the high voltage supply being less than 0.3 micro amps.

Preferably the leakage is less than 0.03 microamps.

In prior art spraying devices, the majority of the current supplied by the high voltage generator is surface leakage current and unwanted corona discharge, only a proportion being spraying current i.e. current actually used to charge the spray. For example a known hand held electrostatic crop spraying device has a spray current (to charge the spray) of about 0.5 micro amps and a leakage current which, in use, can be as high as 5 micro amps. Reducing the surface leakage enables a smaller generator to be used producing a potential cost savings.

In accordance with another aspect of the invention, there is provided an electrostatic spraying device comprising: a nozzle, means for supplying liquid to the nozzle, high voltage supply means having a high voltage output supplying a high voltage circuit comprising one pole of the high voltage output connected, in use, so that one or more ligaments of liquid is/are propelled from the nozzle, the ligaments breaking up into electrostatically charged droplets, the high voltage supply means having a maximum output current when the device is spraying of 1.5 micro amps at 15 kV in the case of a single ligament or 0.8 micro amps per 15 kV+0.15 micro amps per ligament in the case of more than one ligament.

For example, the high voltage supply means may have a maximum output current when the device is spraying of 0.6 micro amps at 15 kV in the case of a single ligament or 0.3 micro amps per 15 kV+0.15 per ligament in the case of multi-ligament spraying. Where the liquid being sprayed has a suitable resistivity, i.e. of the order if $10^8$ ohm. cm or above, the consumption of current by non- catastrophic corona discharge is negligible and maximum output current that the high voltage supply means is capable of producing may be 0.33 micro amps per 15 kV for a single ligament sprayer or 0.03 per 15 kV+0.15 per ligament in the case of a multi-ligament sprayer.

As referred to above, it is to be understood that a reference to a maximum output current capability of for example 0.6 micro amps at 15 kV means that at 15 kV, the maximum current output capability is 0.6 micro amps but for high voltage supply means designed to operate at other voltage outputs, the maximum current output capability applicable is proportionally related so that, for instance, at an operating votage of 20 kV the maximum current output capability is $20/15\times0.6$, i.e. 0.8 micro amps.

Where the device of the invention is designed to produce multi-ligament spraying (e.g. using an annular or linear nozzle with an extended discharge edge), it is preferably arranged to operate so as to produce a ligament to ligament pitch of at least 400 microns.

In accordance with yet another aspect of the invention there is provided electrostatic spraying device comprising: a nozzle, means for supplying liquid to the nozzle, high voltage supply means having a high voltage output supplying a high voltage circuit comprising one pole of the high voltage output connected, in use, so that liquid sprayed from the nozzle is electrostatically charged, the greatest average potential gradient, in normal use, across surfaces of the device between conductors or semiconductors connected to opposite poles of the high voltage output being less than 3 kV per cm.

Preferably the greatest average potential gradient across such surfaces is less than 2 kv per cm.

Preferably where the device is so designed that portions of such surfaces are disposed in such a way that potential current leakage paths exist across gaps between those surface portions, in normal use of the devices the air pathway potential gradient between any such surface portions is no greater that 6 kV/cm.

In comparison with normal practice at high voltages, the potential gradient is much less. This reduces the surface leakage current, so reducing the load on the generator. The generator may therefore be built less expensively.

In a yet further aspect of the invention, the liquid to be sprayed is contained in a pressurised container having a delivery valve which, in use, is opened by relative movement of the container and the nozzle towards each other, the device having a body or body part from which the nozzle extends, said valve being opened, in use, by relative movement between the container and the body or body part, the nozzle remaining fixed in relation to the body or body part.

Preferably, the body or body part is formed in one piece so that it is uninterrupted round its periphery, and formed of insulating plastics material, the nozzle projecting from one end and movement being applied to the container from the other end to operate the valve The high voltage supply circuit may comprise a generator situated on a side of the container remote from the nozzle and having a high voltage connector for electrical connection thereto, the low voltage circuit of the generator being remote from the container, movement being applied to the container through the generator to operate the valve.

The generator preferably produces a unregulated output voltage, ie without employing any feedback-dependent form of voltage regulation, thereby allowing the generator to be constructed cheaply. Such a generator is particularly applicable to single ligament spraying since such spraying can tolerate a relatively wide range of operating voltages.

In a preferred embodiment of the invention the generator comprises means for converting a low voltage from a dc supply into a relatively low ac voltage, means for storing the energy content of said ac voltage, means for repeatedly discharging the energy-storing means to produce a relatively low magnitude higher frequency decaying oscillatory voltage, high gain transformer means for converting said higher frequency voltage to a large magnitude decaying oscillatory voltage (typically at least 10 Kv), and means for rectifying said large magnitude voltage to provide a uni-polar high voltage output which, when applied to the device, is subject to smoothing by capacitive elements associated with the device.

Such a generator can be manufactured in a compact form and at lower cost than generators of the type used conventionally which employ an array of voltage multiplier circuits to convert a low input voltage into a high voltage suitable for use in electrostatic spraying devices, and the preferred generator does not require feedback control to produce a regulated voltage output as used in conventionally used generators.

In a still further aspect of the invention there is provided an electrostatic spraying device having a nozzle and a surface near the nozzle which is sufficiently insulated as to charge to a high voltage, in use, whereby the spray from the nozzle is repelled therefrom. This reduces the amount to which the sprayed droplets spread, which may be desirable in some cases. In a preferred embodiment the surface is annular.

BRIEF DESCRIPTION OF THE DRAWINGS

Embodiments of the invention will now be described, by way of example, with reference to the accompanying drawings, in which.

DETAILED DESCRIPTION

Figure 1A:
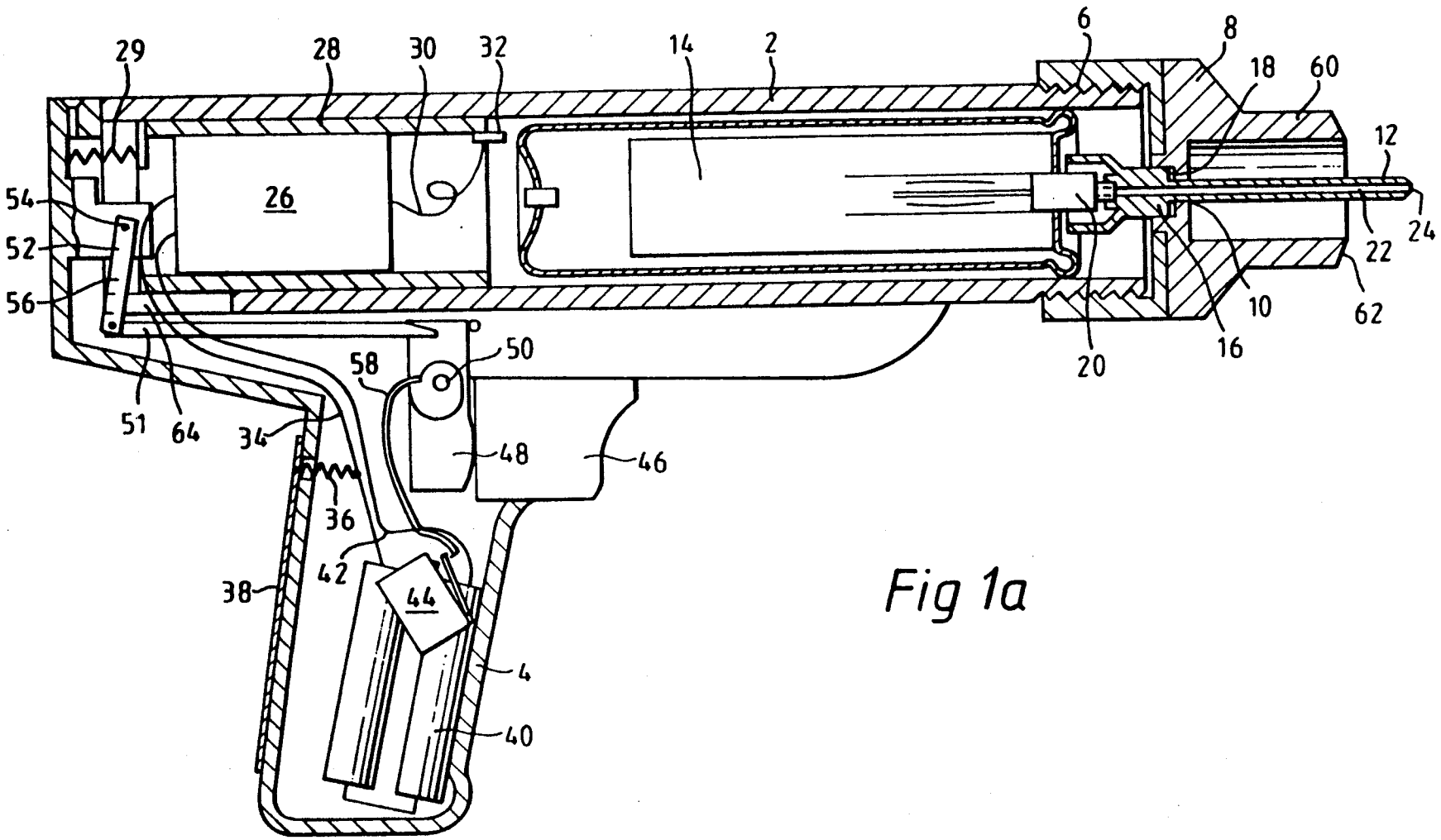
FIGS. 1*a* and 1*b* are a cross section of an electrostatic spray gun embodying the invention.

The invention may be embodied in any shape convenient to the purpose to which it is to be put. The embodiments illustrated are both in the form of a spray gun.

The spray gun illustrated in FIG. 1 has a body member 2 and a hand grip 4. The body member 2 is in the form of an tube of insulating plastics material. The tube is integral, that is to say it has no breaks round its periphery in contrast to a clam shell moulding. Suitable materials will usually be selected from a group defined by a bulk resistivity preferably greater than $10^{14}$ ohm cm. Given suitable thicknesses of material such bulk resistivities reduce the leakage through the material to a negligible amount. The problem is that at high voltages the leakage across the surface becomes important so that there is a requirement for high surface resistivity values in use. Thus materials which contaminate easily or absorb water easily are not suitable. For example it is preferred that the material does not absorb more than 0.7% by weight of water. Examples of suitable materials are ABS, polypropylene, polyethylene, some grades of polyvinyl chloride, acrylic, polycarbonate, acetal.

The body member is externally threaded at its end 6 to receive an end cap 8, which may also be of plastics material selected from the same group. Alternatively the end cap may be of a less insulating material, for example Tufnol Kite brand. The end cap 8 has a central aperture 10 through which, in use, a nozzle 12 projects. Means are provided, in the form of a container 14, for delivering liquid to be sprayed to the nozzle. The nozzle 12, which is permanently attached to the container 14, has a shoulder 16 which is received by a recess 18 on the inside of the end cap, thereby to locate the nozzle accurately centrally of the end cap. The container may be replaced by removing the end cap.

The container is pressurised by a liquefied propellant, e.g. fluorocarbon 134A, which is separated from the liquid to be sprayed by a metal foil sack 19 (only part of which is shown). The supply of fluid to the nozzle 12 is switched on and off by a valve 20 with which a passage 22 in the nozzle communicates. As in the case of an aerosol can, pressing the valve 20 relatively towards the container 14 opens the valve allowing liquid to be propelled from the container by the pressurised propellant and into the passage 22 of the nozzle. An internal restriction in the container 14 limits the flow rate to a low value, e.g. 1 cc per minute and so that the liquid arrives at the outlet 24 of the nozzle at very low pressure which is not sufficient to cause any or significant atomisation. The nozzle may be conducting or insulating. It is preferred that the nozzle is insulating. The container 14 is conducting, in this example.

Figure 5:
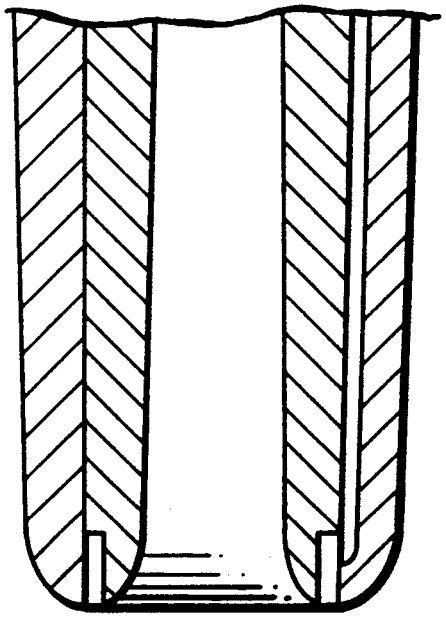
FIG. 5 is a cross-sectional view of a multi-ligament spray nozzle which may be used with the spray gun of the invention

In the examples illustrated a single ligament issues from the tip of the nozzle. In other examples, as schematically shown in FIG. 5, the nozzle may be annular or in the shape of a plane blade so that a plurality of ligaments of liquid issue therefrom. Such nozzles are known, see e.g. U.S. Pat. No. 4,398,671 (FIG. 7), and do not, without more, form a part of this invention.

At the end of the body member 2 remote from the nozzle 12, a high voltage generator 26 is situated in a tubular carriage 28. The carriage 28 is slidable in the body member 2 and is biased away from the end cap 8 by a tension spring 29. The generator has a high voltage output pole 30 connected to a contact schematically indicated at 32 for contact with the conducting container 14. The other high voltage output pole is electrically common with a low voltage supply lead 34 and thus connected via a resistor 36 to a contact strip 38 on the exterior of the hand grip 4. The low voltage supply lead is connected to one pole of a battery 40. The other pole of the battery is connected to the generator by another low voltage supply lead 42 via a microswitch 44.

In order to increase the length of the leakage path from the high voltage output pole 30 to the lead 34 on the low voltage side of the generator, the generator is hermetically sealed in the carriage 28, e.g. by encapsulating the generator in the carriage 28 so that there is no direct surface path inside the tubular carriage 28 between the one high voltage pole 30 of the generator and the other pole 34. The insulation on the low voltage leads 34 and 42 is sufficient that there is no significant leakage through the bulk of the insulation in relation to surface leakage to a break in the insulation at the connection with the resistor 36.

Figure 3:
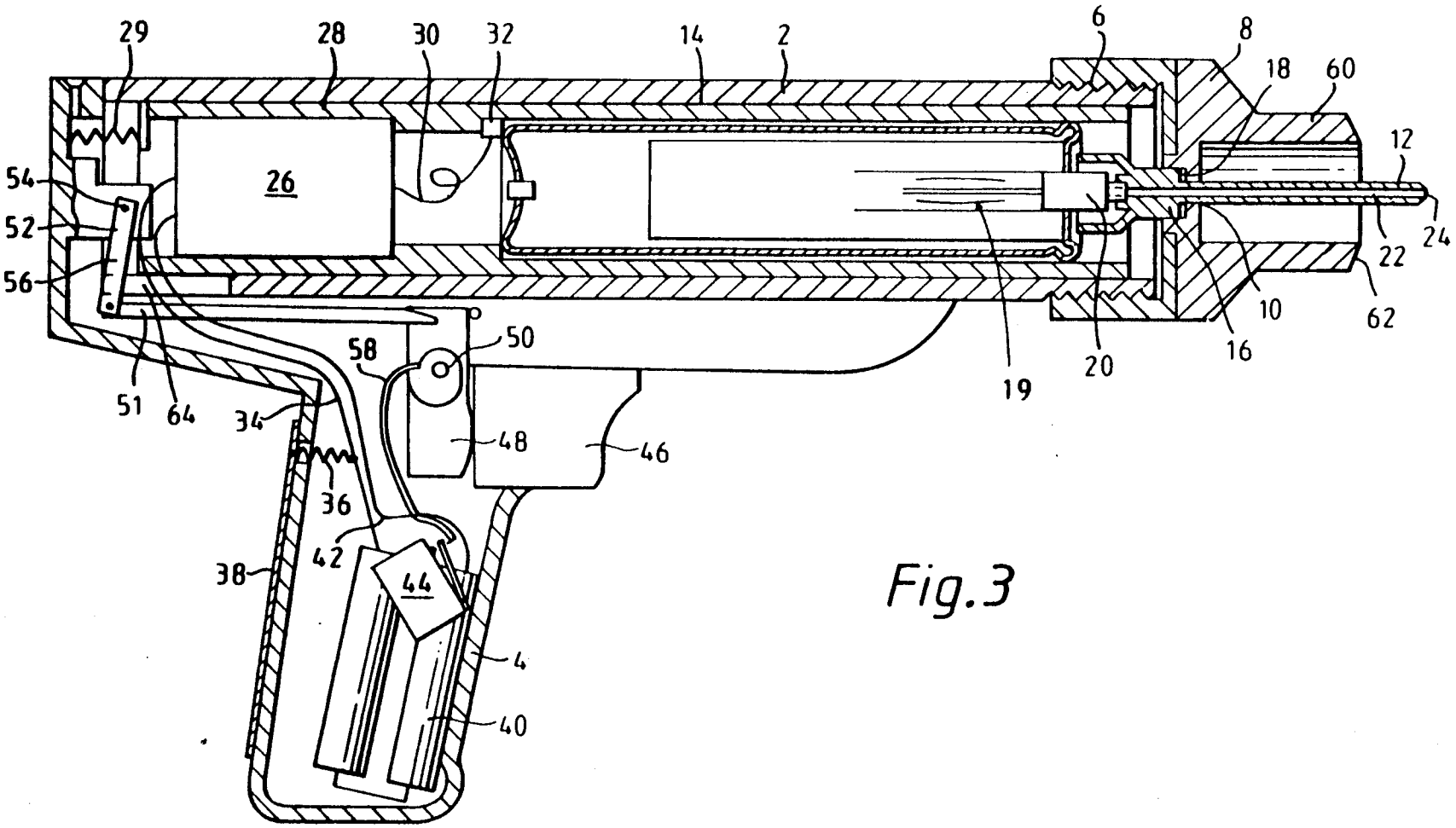
FIG. 3 is a view similar to FIGS. 1*a* and 1*b* but showing a modification thereof.

In a version, as illustrated in FIG. 3, the tubular carriage 28 is extended towards the nozzle end of the container 14 and is sufficiently large for the container to fit therein. This both lengthens the leakage path from the container to the resistor 36, and ensures that if there is any spillage from the container 14, it is contained by the carriage and does not contaminate the leakage path.

The valve 20 is opened, in use, by relative movement between the container 14 and the body 2, the nozzle 12 remaining fixed in relation to the body. Movement to operate the valve is applied to the container by movement of the generator. To this end, the grip 4 has a trigger 46 which when squeezed operates on one end of a lever 48 which is pivotally mounted at 50. Movement of the lever 48 is communicated by a link 51 to a further lever 52 which is pivotally mounted at one end 54. A central portion 56 of the lever 52 bears on the end of the carriage 28 remote from the container 14 so that when the trigger 46 is squeezed, resulting movement thereof is translated into movement of the carriage, and thus the container, towards the nozzle, so opening the valve 20. As this happens a linkage 58 operates the microswitch 44 so that power is supplied to the generator. The high voltage output from the generator is thus applied to the container and so to the liquid therein. The high voltage is thus conducted to the tip of the nozzle, via the liquid in the case of an insulating nozzle, where the electric field strength is sufficient to produce a charged spray. The spray may be formed preponderantly by electrostatic forces, suitable liquids for such operation preferably having a resistivity in the range $1\times10^5$ to $5\times10^{10}$ ohm cm in the case of non-aqueous liquids. In the case of more conducting liquids and aqueous systems, a jet may be produced by hydraulic pressure, even in the absence of the high voltage, which jet breaks up into coarse droplets. The addition of the high voltage improves the spray by decreasing the droplet size and, since like charges repel each other, spreading the spray out into more of a cloud.

The end cap 8 has an annular shroud 60 also formed of insulating material. In initial operation of the spray gun small amounts of charge accumulate on the outer edge 62 of the shroud. As the shroud is insulating, e.g. being made of non conducting material, e.g. Tufnol, ABS, polypropylene, polyethylene, polyvinyl chloride, acrylic polycarbonate, acetal, and supported on the insulating body 2 leakage is sufficiently slow as to leave the shroud charged. The charge on the edge is of the same polarity as the spray which it thus repels. This reduces the tendency of the spray to lift or spread out. The shroud 60 can thus be used to control the shape of the spray and to this end may be adjustable or there may be several different interchangeable shrouds.

In use the grip is held in a hand and the trigger is squeezed as explained above. The hand contacts the conducting strip 38 to provide an earth return circuit. In relation to the high voltage circuit, any point on the relatively conducting hand is effectively short circuited to the conducting strip 38 and thus to the output pole of the high voltage generator which is connected thereto in common with the low voltage input pole.

Figure 1B:
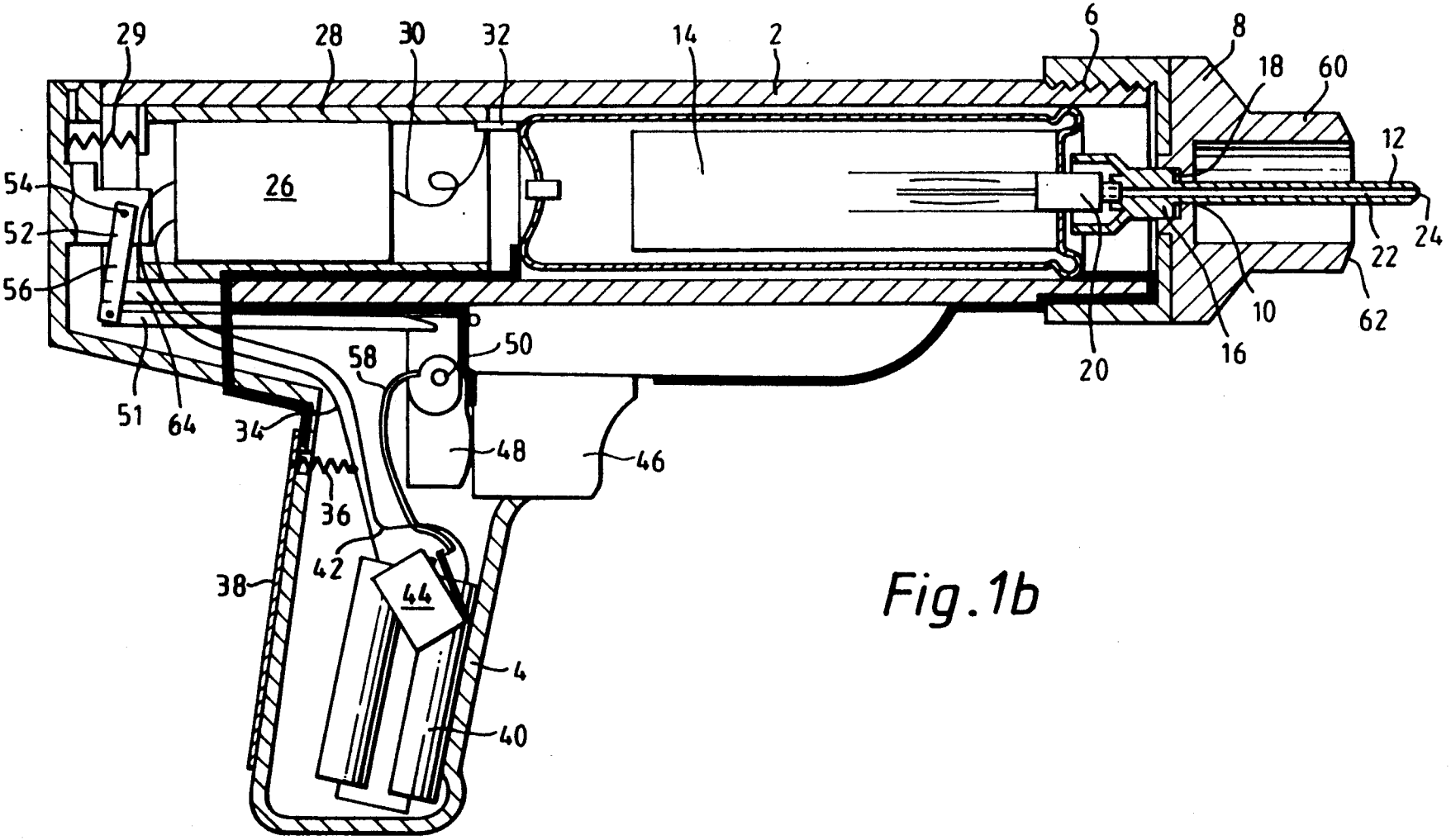

The two shortest leakage paths between the high voltage output poles of the generator are indicated in the drawing by the heavy outlines in FIG. 1*b*.

Recalling that in use the carriage is pressing against the rear of the container 14, one of these leakage paths is from the rear of the container 14, along the surface inside the body member 2 between it and the carriage 29, through a slot 64 through which the link 51 and lever 52 connect, and over the outer surface of the grip 4 to the conducting strip 38.

From the slot 64 in the body there is also a sub leakage path over the external surface of the tubular body member 2 (but inside the hand grip) to the finger of the operator squeezing the trigger.

Another leakage path is from the front of the container 14 across internal surfaces of the body member 2, across the surfaces through the screw thread of the end cap and over the external surfaces of the body member 14 and grip 4 to the hand of the operator and so to the conducting strip 38.

In contrast to the situation if the body member 2 were a clam shell moulding, there is no direct surface path through the body member 2 since this is an integral tube.

The generator is unregulated and has a rectified output such that, at the load presented by the spraying current and the leakage, it operates at a voltage of about 15 kV. The distance of the shortest leakage path is designed to be about 8 cm, giving an average potential gradient over the shortest leakage path of 1.88 kV per cm. In practice the average potential gradient should not be greater than 3 kV per cm, preferably not greater than 2 kV per cm. By design of the gun with regard to such parameters, the leakage current can be reduced to less than 0.3 micro amps, more preferably to less than 0.03 micro amps. At a spraying rate of 1 cc per minute in the illustrated embodiments using a liquid formulation having a resistivity of the order of $10^8$ ohm.cm or greater, the spraying current (the current which actually charges the liquid) is less than 0.1 micro amps. In multi-ligament sprayers, the usual maximum spraying current per ligament would be about 0.15 micro amps. In the case of a single ligament sprayer as illustrated, the maximum spraying current would be about 0.3 micro amps. Thus, a 15 kV generator which in operation, has a maximum output current capability of 0.6 micro amps at the load presented by the spraying current and the leakage, would be adequate for most applications. In other words, in order to achieve the benefits of a low cost generator, for high resistivity liquids of the order of $10^8$ ohm. cm and above a 15 kV generator which when spraying produces a current which is a maximum of 0.6 microamps for a single ligament sprayer is all that is required, since the spraying current is not more than 0.3 microamps and the leakage current is not more than 0.3 microamps. Where the leakage is limited to 0.03 microamps, a generator having a maximum output current capability of about 0.33 micro amps at 15 kV is all that is required so as to provide up to 0.3 micro amps spraying current and 0.03 micro amps leakage. In a single ligament sprayer, the spraying current is sometimes higher than is usual in a multi ligament sprayer. In a multi-ligament sprayer, the spraying current would not normally be above, say, 0.15 micro amps per ligament per 15 kV. For a multi ligament sprayer all that is required is a generator which, when actually working in the device, provides an output current no greater than 0.15 micro amps per ligament plus an amount for leakage of 0.3 micro amps, preferably 0.03 micro amps.

In the foregoing it has been assumed that current consumption through non-catastrophic corona discharge is negligible, which is generally the case especially for single ligament spraying where the operating voltage of the generator is typically of the order of 15 kV but generators with operating voltages up to 25 kV may be used without generating excessive corona discharge especially when used to spray liquids having resistivities of the order of $10^8$ ohm. cm. In some circumstances however, even with operating voltages of the order of 15 kV, corona discharge may consume current in amounts which are comparable or even greater than the spraying current. For example, in multi-ligament spraying with liquids of high resistivity, current consumption resulting from corona discharge will usually be negligible but may become substantial, for instance up to 1 micro amp, if dry spots develop at the spraying edge especially in the case of linear nozzles, as are often used for multi-ligament spraying. Also in the case of single ligament spraying using liquids having low resistivity, eg of the order of $5\times10^6$ ohm. cm, or liquids containing conductive particles, corona discharge can give rise to current consumption of up to about 0.5 micro amps (usually less). Multi-ligament spraying is generally not practicable with low resistivity liquids. Thus, where a spraying device is to be used in circumstances where there may be non-negligible current consumption due to corona discharge, the generator may be selected accordingly so that it has a maximum current output capability which is adequate to meet the load presented by the spraying current, the surface leakage path current and the current consumed by any corona discharge. Generally, where non-negligible current consumption by corona discharge is to be catered for, a generator with a maximum output current capability of about 1.5 micro amps will suffice and can be fabricated as a low cost unregulated generator of the type described herein with reference to FIG. 4 of the drawings.

Figure 2A:
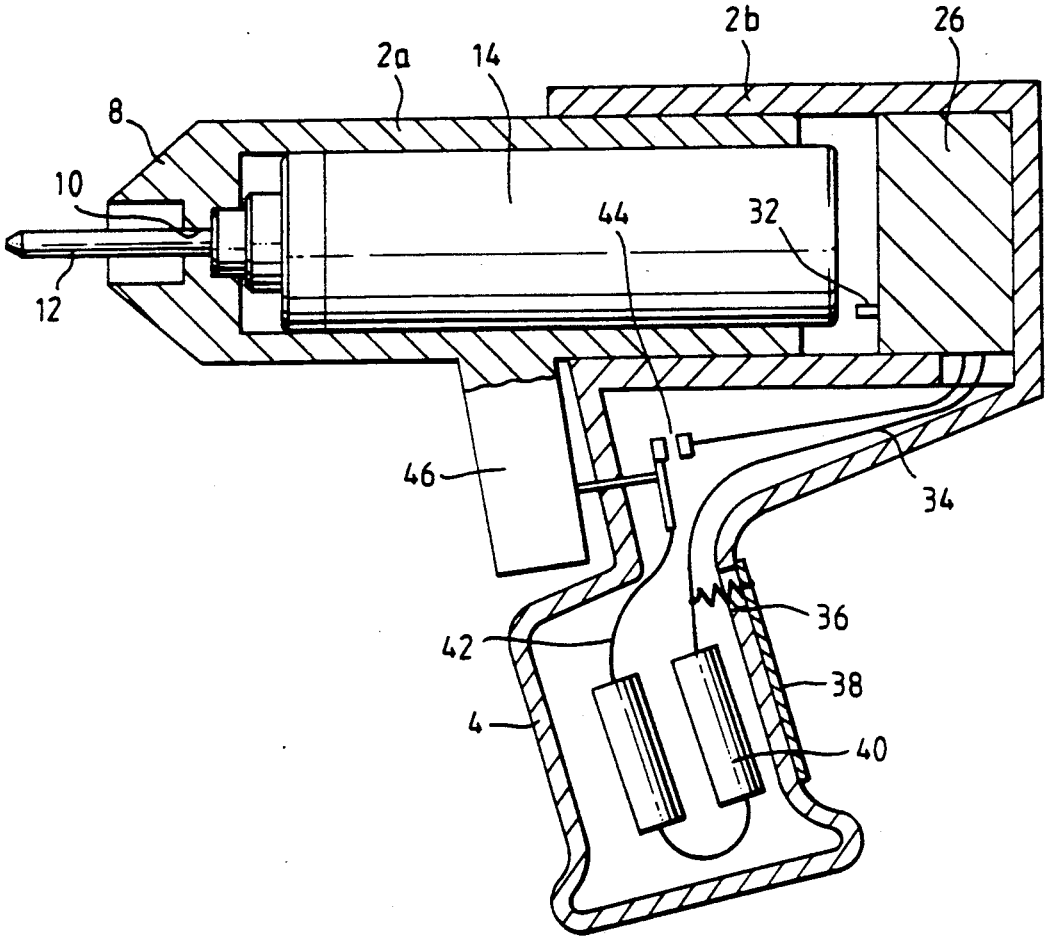
FIGS. 2*a* and 2*b* are a cross section of another electrostatic spray gun embodying the invention.

The embodiment illustrated in FIG. 2*a* is similar to that of FIG. 1*a* except for the way in which the generator is mounted and the way the can is pressed to operate the valve.

In this embodiment the container is mounted in a tubular body part 2*a* equivalent to the body member 2 in the embodiment of FIG. 1. The body part 2*a* has an end cap 8, which in this case is shown integral with the tubular part 2*a*. The part 2*a* again is formed with no breaks round its periphery, e.g. by moulding. The part 2*a* has a trigger 46 which is fixed thereon. Another body part 2*b*, in which the body part 2*a* telescopes, carries the generator 26 and has a hand grip 4 fixed thereon. The body parts 2*a* and 2*b* are biased apart by means not shown.

In operation the trigger 46 is squeezed towards the hand grip until the contact 32 on the generator meets the end of the container 14. Further pressure moves the container 14 in relation to the body part 2*a* whilst, again, the nozzle remains stationary in the part 2*a*. This movement operates the valve to supply liquid from the container to the nozzle producing a spray of electrostatically charged liquid as explained above.

Figure 2B:
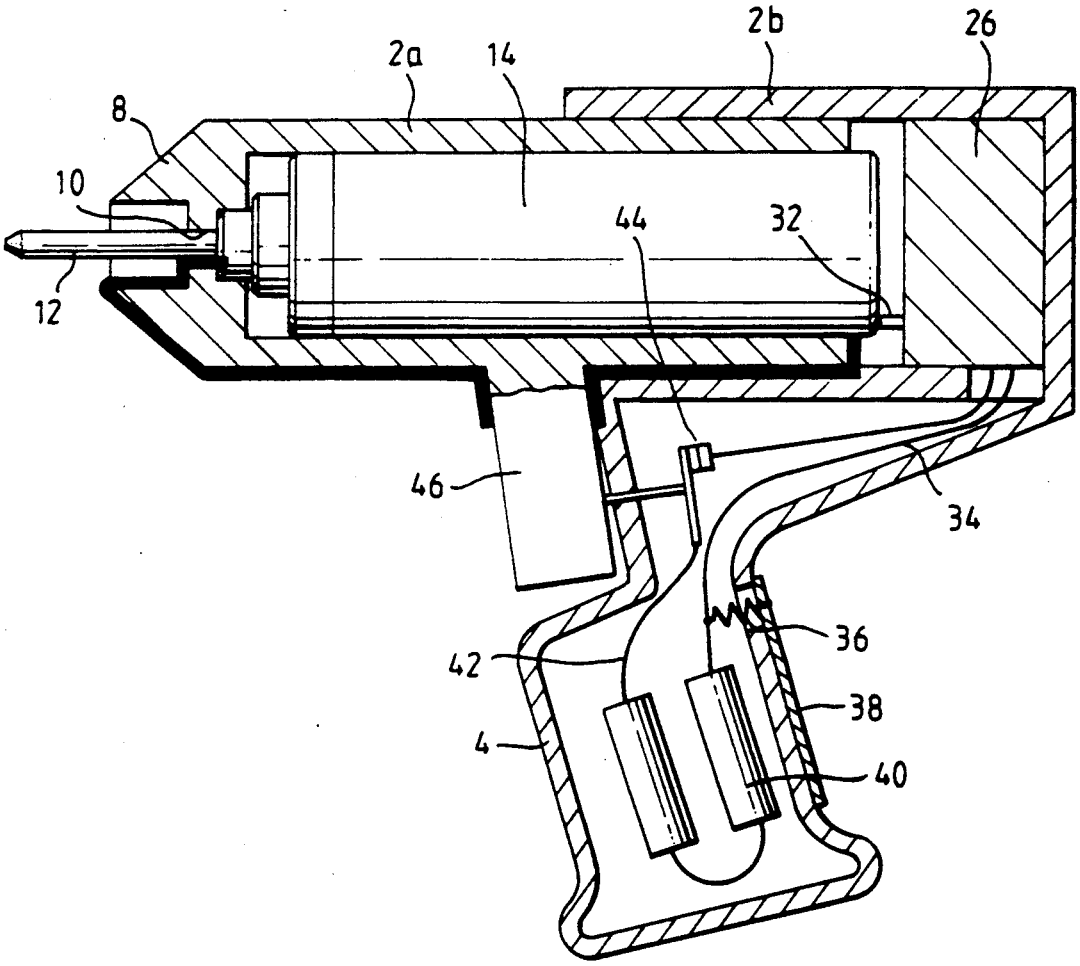

The two shortest leakage paths are also shown in heavy outline in FIG. 2*b* and are similar to those shown in FIG. 1*b* . One of the paths is from the rear of the container 14, along the surface between the parts 2*a* and 2*b* to the hand operating the trigger and so to the conducting strip 38. The other path is from the front of the can over the inside surfaces of the part 2*a* through the opening 10 (the nozzle is insulating), over the outer surfaces of the part 2*a* to the operator's hand and so to the conducting strip 38. The leakage paths are sufficiently long to achieve the required low leakage currents enabling use of the same low current generator as in the embodiment of FIG. 1.

Figure 4:
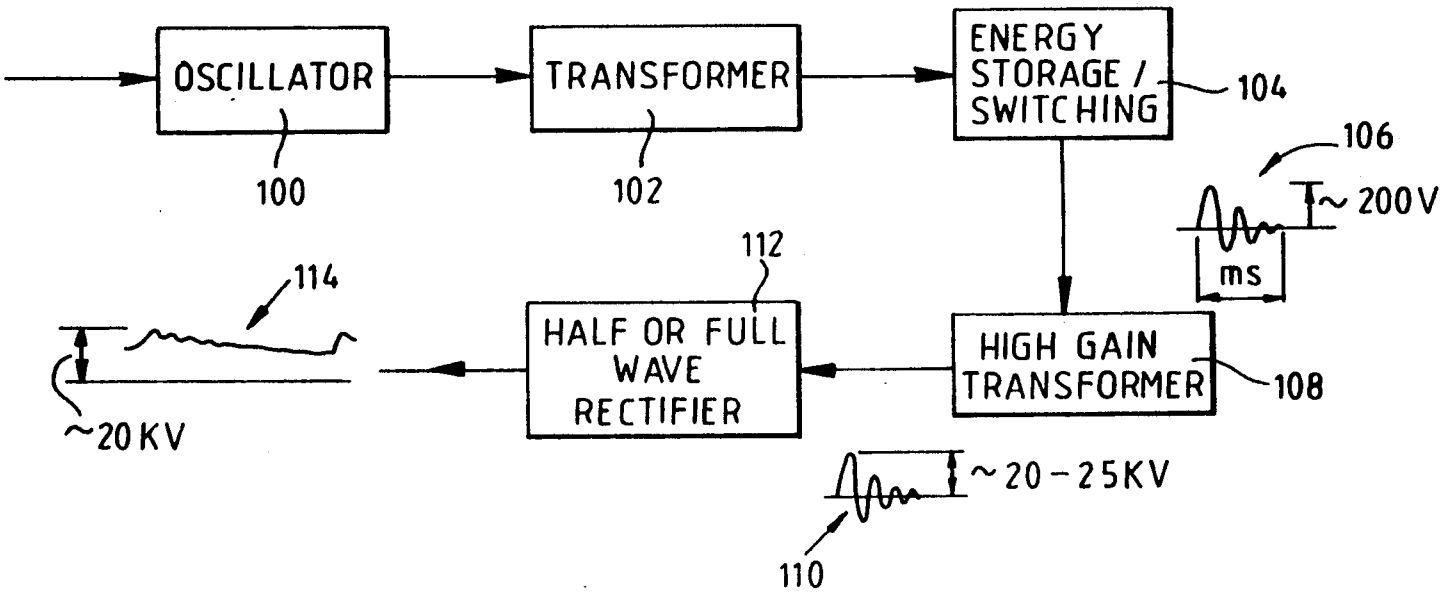
FIG. 4 is a block diagram of the circuitry of the high voltage generator employed in the embodiments of this invention.

Referring to FIG. 4, the high voltage generator described previously is preferably one which does not require the use of an array of voltage multiplier circuits as in conventional generators. Thus as shown, the generator comprises an oscillator 100 receiving as its input the dc voltage provided by the battery pack 40 shown in FIG. 1*a* for example. Typically, this input voltage is of the order of 9 v. The oscillator 100 provides an oscillating output, typically of the order of 100 Hz, which is converted by transformer 102 into a relatively low magnitude ac voltage (typically ca. 200 v) which is applied to an energy storage and switching circuit 104, using capacitive elements to store the energy content of the output from the transformer 102. The circuit 104 is designed in such a way that the energy stored capacitively is repeatedly discharged at a frequency typically between 5 and 20 Hz, thereby producing an oscillatory output of a decaying nature (see signal depicted by reference 106), the peak output voltage of which is typically 200 v and the decay rate being such that the signal decays to virtually zero voltage within a millisecond or so. The pulsed signal 106 is applied to a high gain transformer 108 which converts it to a voltage of the order of 20–25 kV (signal 110) and this signal is then applied to a half wave or full wave rectifier circuit 112 to produce the unipolar high voltage output 114 of the generator. The signal 114 is shown in its smoothed form, the smoothing being effected by stray capacitances associated with the device.

One form of generator suitable for use in the embodiments described herein is disclosed in European Patent Application No 163390.

Although the embodiments described above have used electrical contact between the liquid and a conductor, in the form of the container, to charge the liquid, other arrangements are possible. For example in another such arrangement, there is no electrical contact between the liquid and the high voltage output of the generator but a ring electrode, connected to the high voltage output of the generator surrounds the nozzle and charges the liquid by induction.

In another example, not illustrated, the nozzle is made of a porous material similar to that used for the writing element in a felt tip pen. The container may not then need to be pressurised, supply of liquid to the nozzle relying on capillary action.

Whereas the main teaching of this specification relates to the reduction of leakage across the surface of the device, those skilled in the art will recognise that the device should be of suitable materials and should have suitable radii and corner radii to reduce corona discharge to a minimum so as to reduce unwanted effects of corona in loading the generator.

In order to measure leakage currents, the following technique is suggested. All the parts of the device should be assembled in their working positions, with the exception of the generator which is replaced with a non working dummy having dummy electrical connectors in places corresponding to those in the real generator. The container should either be empty or it should be ensured that there is no liquid delivered. When the nozzle is dry, especially if it is conducting, there is a tendency for corona to discharge therefrom. To prevent this the nozzle tip should be fitted with a cover sufficiently insulating and of sufficiently large diameter as to prevent corona discharge. An external generator, adjusted to the operating voltage, has its high voltage circuit connected across the dummy high voltage poles of the dummy generator, e.g. between the container and the conducting strip 38. A sensitive ammeter or electrometer is connected to measure the current from the external generator, which current represents the leakage current of the device in use.

The spraying current and any current consumed through corona discharge may be determined by using the device (with a live generator) to spray the liquid towards an imperforate catch target (e.g. a metal sheet) and interposing a grid of fine wire gauze between the device and the catch target so that the corona current is collected by the grid and the charged spray droplets are collected by the catch target. The grid and target may be connected to respective ammeters to allow the different current components to be measured. In practice, some of the droplets may tend to deposit on the grid but this can be minimised by making the aperture size defined by the intersecting wires of the grid suitably large (e.g. 2.5 cm square).

I claim:

1. An electrostatic spring device comprising:

a nozzle, means operatively coupled to said nozzle for supplying liquid to the nozzle, high voltage supply means having a high voltage output supplying a high voltage circuit, one pole of said high voltage output being operatively connected to at least one of said nozzle and said means for supplying liquid to thereby apply high voltage to liquid supplied to and through the nozzle so that liquid sprayed from the nozzle is electrostatically charged, said device being configured so that leakage between poles of the high voltage output of the high voltage supply is less than 0.3 micro amps.

2. An electrostatic spraying device as claimed in claim 1, wherein the leakage is less than 0.03 microamps.

3. An electrostatic spraying apparatus comprising:

a nozzle, means operatively coupled to said nozzle for supplying liquid to the nozzle, high voltage supply means having a high voltage output supplying a high voltage circuit, one pole of the high voltage output being operatively connected to at least one of said nozzle and said means for supplying liquid to thereby apply high voltage to liquid supplied to and through the nozzle so that at least one ligament of liquid is sprayed from the nozzle, each ligament breaking up into electrostatically charged droplets, the high voltage supply means having a maximum output current when the device is spraying of 1.5 micro amps at 15 kV when a single ligament is sprayed from the nozzle, and a maximum output current when the device is spraying of 0.8 micro amps per 15 kV+0.15 micro amps per ligament when more than one ligament is sprayed from the nozzle.

4. An electrostatic spraying device as claimed in claim 3, wherein the maximum output current of the generator is 0.3 micro amps at 15 kV when a single ligament is sprayed from the nozzle, and 0.3 micro amps per 15 kV+0.15 micro amps per ligament when more than one ligament is sprayed from the nozzle.

5. An electrostatic spraying device comprising:

a nozzle, means operatively coupled to said nozzle for supplying liquid to the nozzle, high voltage supply means having a high voltage output supplying a high voltage circuit, one pole of the high voltage output being operatively connected to at least one of said nozzle and said means for supplying liquid to thereby apply high voltage to liquid supplied to and through the nozzle so that liquid sprayed from the nozzle is electrostatically charged, said device being configured so that the greatest average potential gradient across surfaces of the device between conductors or semiconductors connected to opposite poles of the high voltage output is less than 3 kV per cm.

6. An electrostatic spraying device as claimed in claim 5, wherein said greatest average potential gradient is less than 2 kV per cm.

7. An electrostatic spraying device as claimed in any one of claims 1–6, further comprising a pressurized container, having a delivery valve the liquid to be sprayed being contained in said pressurized container and further comprising a body member from which the nozzle extends, said valve being opened by relative movement between the container and the body member, the nozzle remaining fixed in relation to the body member.

8. An electrostatic spraying device as claimed in claim 7, wherein the body member is continuous about its periphery, and is formed from insulated plastics material.

9. An electrostatic spraying device as claimed in claim 7, wherein the high voltage supply circuit comprises a generator mounted to a side of the container remote from the nozzle and having a high voltage connector, the low voltage circuit of the generator being remote from the container.

10. An electrostatic spraying device as claimed in any one of claims 1, 3 and 5, wherein the nozzle is made of insulating material.

11. A device as claimed in any one of claims 1, 3 and 5, in which the generator comprises means for converting a low voltage from a dc supply into a relatively low ac voltage, means for repeatedly discharging the energy-storing means to produce a relatively low magnitude higher frequency decaying oscillatory voltage, high gain transformer means for converting said higher frequency voltage to a large magnitude decaying oscillatory voltage and means for rectifying said large magnitude voltage to provide a smoothed uni-polar high voltage output.

12. A device for spraying liquids, comprising:

a housing adapted to be hand held, a container for a liquid to be sprayed mounted within the housing, a nozzle from which the liquid is to be sprayed, means for feeding the liquid from the container to the nozzle, and high voltage means for applying electrostatic potential to the liquid so that the liquid issues from the nozzle in the form of an electrically charged atomized spray, the housing being adapted to reduce leakage of current from the high voltage means, the container being collapsible and means being provided for compressing the container in order to effect feed of liquid to the nozzle.

13. A device as claimed in claim 12 in which the container is provided with a valve and in which opening of the valve is effected in response to movement of the container relative to the housing.

14. A device as claimed in claim 12 in which the collapsible container is enclosed within a casing containing fluid pressurizing the container.

15. A device as claimed in claim 12 in which the collapsible container is received in the housing as a replaceable unit.

16. A device as claimed in claim 12 in which the collapsible container is enclosed within a carrier which is mounted for movement within the housing and in which the container is provided with a valve which, in response to movement of the carrier in a predetermined direction, is opened, said compressing means being effective to expel liquid from the container upon opening of the valve in response to such movement.

17. A device as claimed in claim 12 further comprising a user-operable trigger mounted to said housing for controlling feed of liquid by the compressing means.

18. A device as claimed in claim 12 in which the high voltage means comprises an HT generator mounted for movement within the housing, movement of the HT generator being effected in response to operation of a user-operable member and feed of liquid from the container being controlled in response to such movement of the HT generator.

19. A device as claimed in claim 12 in which the container is mounted to a carrier for movement within the housing and the compressing means is controlled in response to movement of the container to effect enabling and disabling of liquid feed to the nozzle.

20. A device as claimed in claim 12, wherein said high voltage means has a high voltage output supplying a high voltage circuit, one pole of said high voltage output being operatively connected to at least one of said nozzle and said means for feeding the liquid to thereby apply said high voltage to the liquid, said housing reducing leakage to less than 0.3 micro amps.

21. A device as in claim 12, wherein said high voltage means has a high voltage output supplying a high voltage circuit, one pole of said high voltage output being operatively connected to at least one of said nozzle and said means for feeding the liquid to thereby apply said high voltage to the liquid, the high voltage means having a maximum output current when the device is spraying of 1.5 micro amps at 15 kV when a single ligament is sprayed from the nozzle, and a maximum output current when the device is spraying of 0.8 micro amps per 15 kV+0.15 micro amps per ligament when more than one ligament is sprayed from the nozzle.

22. A device as in claim 12, wherein said high voltage means has a high voltage output supplying a high voltage circuit, one pole of said high voltage output being operatively connected to at least one of said nozzle and said means for feeding the liquid to thereby apply said high voltage to the liquid, and wherein the greatest average potential gradient across surfaces of the housing between conductors or semiconductors connected to opposite poles of the high voltage output being less than 3 kV per centimeter.

* * * * *